US006926026B1

(12) United States Patent
Burgoyne

(10) Patent No.: US 6,926,026 B1
(45) Date of Patent: Aug. 9, 2005

(54) SIPHON INITIATING DEVICE

(76) Inventor: William B. Burgoyne, 5713 Lake West Ter., Glen Allen, VA (US) 23059

( * ) Notice: Subject to any disclaimer, the term of this patent is extended or adjusted under 35 U.S.C. 154(b) by 5 days.

(21) Appl. No.: 10/680,360

(22) Filed: Oct. 8, 2003

(51) Int. Cl.[7] ..... F04F 10/00
(52) U.S. Cl. ..... 137/149; 137/147
(58) Field of Search ..... 137/147, 148, 137/149

(56) References Cited

U.S. PATENT DOCUMENTS

| | | | | |
|---|---|---|---|---|
| 108,087 | A | 10/1870 | Averell et al. | |
| 135,935 | A | 2/1873 | Paynter | |
| 919,079 | A | 4/1909 | Richards | |
| 958,415 | A | 5/1910 | Meade | |
| 1,582,399 | A * | 4/1926 | Helander | 137/148 |
| 2,233,123 | A * | 2/1941 | Fritts | 137/149 |
| 2,783,715 | A * | 3/1957 | Kraus | 137/149 |
| 3,908,689 | A * | 9/1975 | Wingate | 137/149 |
| 4,041,971 | A | 8/1977 | Newsteder | |
| 4,112,963 | A | 9/1978 | Brubaker | |
| 4,232,694 | A | 11/1980 | Williams | |
| 4,290,443 | A * | 9/1981 | Crozzoli | 137/149 |
| 4,301,826 | A | 11/1981 | Beckerer | |
| 4,574,828 | A * | 3/1986 | Brumfield | 137/149 |

* cited by examiner

*Primary Examiner*—Gerald A. Michalsky

(57) ABSTRACT

A siphon initiating device is provided having a cylinder member and slideably interactive hollow piston member, both members equipped with check valves to permit unidirectional flow. Both extremities of the device have threaded fittings for engaging garden hoses. By way of hand manipulated back-and-forth motion of the piston member within the cylinder member, a pumping action is initiated which fills the hoses with water, thereby initiating gravity flow of water through the hoses and initiating device.

9 Claims, 2 Drawing Sheets

SIPHON INITIATING DEVICE

BACKGROUND OF THE INVENTION

1. Field of the Invention

This invention relates to fluid transfer apparatus, and more particularly concerns a device for priming a siphon conduit which facilitates transfer of water between a source volume and a receiving location.

2. Description of the Prior Art

The hydrodynamic principle known as the siphon effect involves the transfer of a liquid by gravity effect from a source volume of the liquid to a receiving location at a lower elevation employing a liquid-filled conduit having a first extremity immersed below the surface of the source volume, an apogee located above the surface of said source volume, and a downstream second extremity located at an elevation generally below said first extremity. The conduit is considered to have upstream and downstream arm portions divided about the apogee, each arm portion terminating in its respective lower, or distal extremity. As long as the conduit remains liquid-filled, and the hydrostatic head of the downstream arm exceeds the hydrostatic head of the upstream arm, water will flow out of the source volume.

A source volume of water, whether confined within a vessel or natural reservoir, is generally bounded by a circuitous confining wall having an upper perimeter. Removal of water from the vessel can be achieved by pumping means or by gravity activated passage through an aperture in said wall located below the surface of the water. The siphon principle provides the advantage of removing water by gravity activated passage above the wall perimeter, thereby obviating the need for an aperture in the wall, or pumping means.

The primary difficulty encountered in establishing a siphon effect is in filling the conduit with the liquid which is to be acted upon. Several approaches for coping with this problem are disclosed in the prior art.

U.S. Pat. No. 4,041,971 to Newsteder describes a siphon starting device involving an inverted U-shaped rigid tube equipped with a manually operated pumping plunger interactive with the bottom extremity of the upstream arm of the U tube. The volume of Newsteder's pumping mechanism is greater than the volume of the U tube. Accordingly, one stroke of the plunger is intended to fill the tube, and begin the siphon effect. A shortcoming of this approach is that there is no assurance that air will be displaced from the U tube as water descends from the apogee into the downstream arm. Greater assurance of air displacement occurs only when the bottom extremity of the downstream arm is immersed below the liquid level in a receiving container.

U.S. Pat. Nos. 135,935; 919,079; 958,415; 4,112,963; 4,232,694 and 4,301,826 disclose manually operated piston pumps interactive with the downstream extremity of a flexible tube. The pump generally has a volume greater than the volume of the flexible tube, whereby a single stroke of the piston initiates the siphon effect. Once flow is initiated, the pump is either removed, or a by-pass conduit is provided for fluid flow.

Bellows-type siphon pumps of plastic construction are well known as emergency devices for removing gasoline from the fuel tank of an automobile. Such bellows pumps are generally interactive with the downstream arm of a flexible plastic tube, and include a check valve which ensures unidirectional fluid flow. In use, the distal extremity of the upstream arm is inserted into the fuel tank. With repeated manipulation of the bellows, fuel is caused to flow out of the fuel tank, through the bellows and into a downstream tube leading to a suitable receiving container.

The aforesaid siphon-initiating devices generally are not capable of lifting water a significant height to the apogee of the siphon tube, and neither are they generally capable of handling large volumes of water. Many potential applications exist for the siphon-based transfer of large volumes of water. For example, above-ground swimming pools often require removal of the contained water, and transfer of the water to a distant site for disposal. Such handling would best be achieved by employing a siphon tube comprised of long lengths of conventional garden hose of ½" to ¾" inside diameter. However, initiation of the siphon effect using tubing of such dimensions cannot easily be accomplished by prior art devices. Similar applications involve transporting water away from flooded regions and flooded basements of buildings.

It is accordingly an object of the present invention to provide a siphon initiating device suitable for transferring large volumes of water.

It is another object of this invention to provide a siphon initiating device useful with flexible siphon tubes of large diameter and considerable length.

It is a further object of the present invention to provide a siphon initiating device of the aforesaid nature which is interactive with conventional garden hose.

It is a still further object of this invention to provide a siphon initiating device of the aforesaid nature of durable, rugged construction amenable to low cost manufacture.

It is yet another object of the present invention to provide a siphon initiating device capable of lifting water a considerable height over the upper perimeter of a wall that retains a source volume of water to be acted upon.

It is an additional object of this invention to provide a siphon system which incorporates a device for initiating the operation of such system.

These objects and other objects and advantages of the invention will be apparent from the following description.

SUMMARY OF THE INVENTION

The above and other beneficial objects and advantages are accomplished in accordance with the present invention by a siphon initiating device comprising:

a) a cylinder member having a smooth internal bore and elongated upon a straight axis between an open inlet extremity and an exit extremity containing means for engaging a garden hose, b) a first check valve disposed within said bore adjacent said exit extremity and adapted to enable water to flow from said bore unidirectionally out of said exit extremity, c) a hollow piston member having an open exit end and inlet end equipped with means for engaging a garden hose, d) sealing means disposed about said piston member in a manner to produce a substantially fluid-tight seal with said bore while permitting reciprocating sliding movement of said piston member within said bore, and e) a second check valve disposed within said piston member and adapted to enable water to flow unidirectionally through said hollow piston member, whereby f) said cylinder member and interactive piston member function as a pump which advances water through said device when said piston member is repeatedly manipulated back and forth within said cylinder member.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Referring now to FIGS. 1–4, an embodiment of the siphon initiating device 10 of this invention is shown comprised of cylinder member 11 slidingly interactive with a hollow piston member 12.

Figure 4:
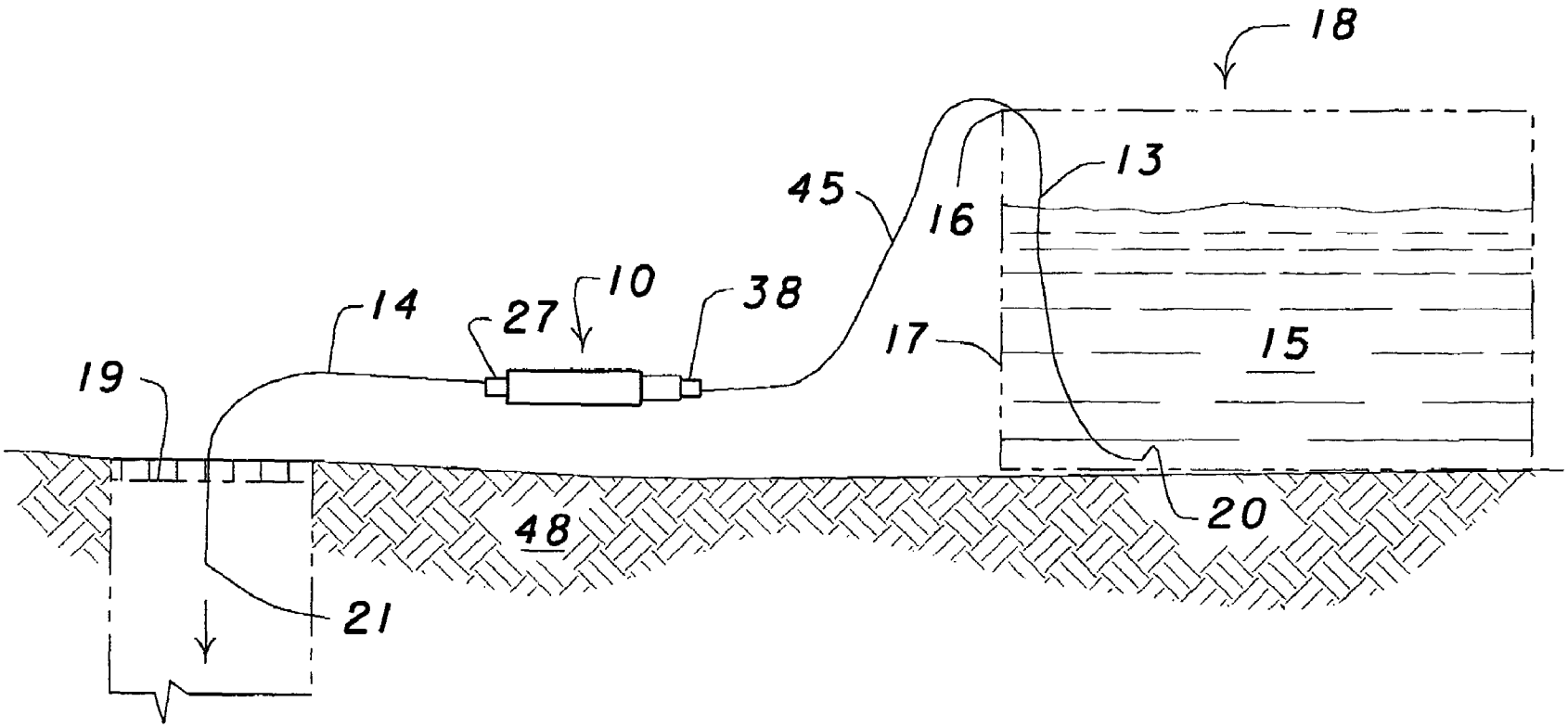
FIG. 4 is a schematic side view showing how the device functions to establish a siphon flow.

In the application illustrated in FIG. 4, upstream and downstream lengths of garden hose 13 and 14, respectively, are employed in conjunction with the device 10 to transfer water 15 over the top perimeter 16 of wall 17 of swimming pool 18 and into a municipal sewer drain 19 at ground level 48. In such application, perimeter 16 represents the apogee of a siphon system wherein the portion of hose extending downwardly from the apogee to distal extremity 20 of length 13 is the upstream siphon arm, and the portion of hose extending downwardly from the apogee, through the device 10 to distal extremity 21 of length 14 is the downstream siphon arm. Said distal extremity 20 is preferably equipped with passive filtering means that prevents entrance of large pieces of debris into the siphon system. It is accordingly noteworthy that the device of this invention is an integral part of the downstream arm of a siphon system.

Cylinder member 11 is of circular cylindrical pipe-like configuration, having a smooth internal bore 26, and is preferably fabricated of a rigid plastic such as polyvinyl chloride (PVC). A suitable commercially available material is "schedule 40" PVC pipe. The outside diameter of said cylinder member may be, for example, 1¼" and it may have a wall thickness of about ⅛" and an inside diameter between about ⅝" and one inch. Cylinder member 11 is elongated upon a straight center axis between an open inlet extremity 23 and an exit extremity 24 having apertured end panel 25. The length of said cylinder member may range between about 24 and 28 inches. A garden hose fitting 27 protrudes from the center of the outside surface 28 of end panel 25. Said fitting 27 may be a continuous integral extension of panel 25 as a portion of a monolithic molded structure. Fitting 27 is preferably a threaded stub whose threading accommodates standard garden hose fittings. In the illustrated embodiment, fitting 27 is fabricated of a metal such as brass in the form of an adapter having an upstream extremity 51 that threadably engages PVC bushing 52. Said bushing is attached to cylinder 11 as an extension thereof by way of coupling collar 53 adhered to both said bushing and cylinder.

A first check valve 30 is disposed within bore 26 adjacent exit extremity 24, and adapted to enable water to flow from said bore unidirectionally out of said exit extremity. Said valve is preferably of simple flapper construction, having a center member 31 pivotably held by a surrounding flat seat member 32.

Piston member 12 is preferably constructed of similar rigid schedule 40 PVC pipe as used for the construction of cylinder member 11. Said piston member is elongated upon said axis between open exit end 34 and inlet end 35 equipped with apertured end panel 36. A garden hose fitting 38 is centered upon the outside surface 39 of end panel 36. Fitting 38 may be similar to fitting 27, and likewise may be integral with panel 36 or incorporated into a bushing added onto the inlet end of said piston member. Alternatively, one of fittings 38 and 27 may be male, and the other female.

Figure 1:
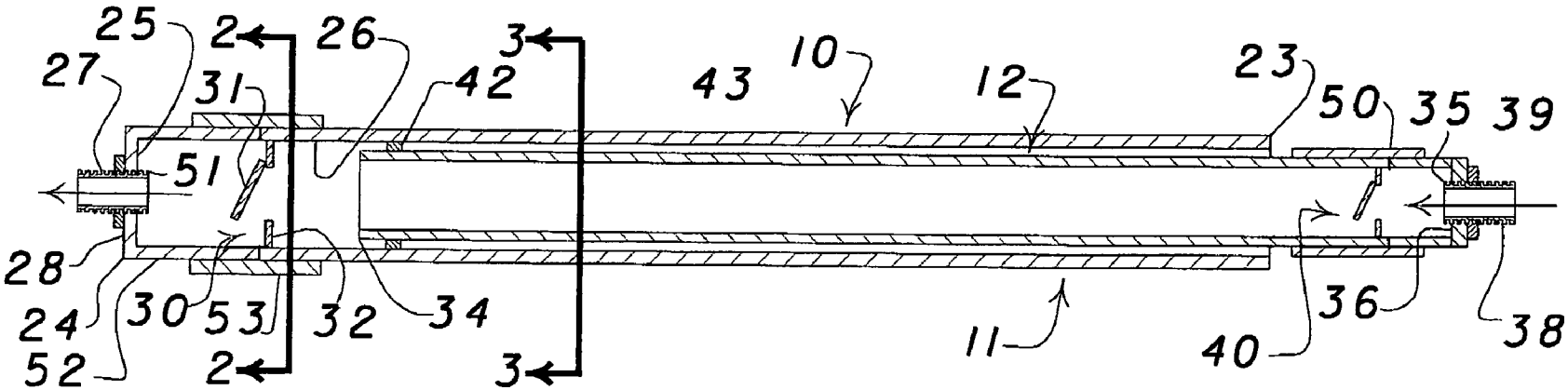
FIG. 1 is a sectional side view of an embodiment of the device of the present invention.
Figure 3:
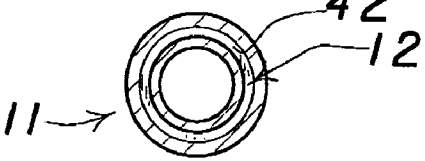
FIG. 3 is a sectional view taken in the direction of the arrows upon line 3—3 of FIG. 1.
Figure 2:
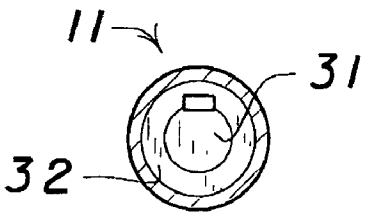
FIG. 2 is a sectional view taken in the direction of the arrows upon the line 2—2 of FIG. 1.

A second check valve 40 is disposed within said hollow piston member adjacent inlet end 35 and adapted to enable water to flow unidirectionally through said piston member, as shown by the axially positioned arrows in FIG. 1. The second check valve is preferably of the same manner of construction as said first check valve.

Sealing means in the form of one or more circular resilient rings 42 are disposed upon said piston member adjacent exit end 34. Said sealing means, which may be of O-ring, washer, or other manner of construction, is intended to produce a substantially fluid tight seal with said bore while permitting reciprocating sliding movement of said piston member within said bore. Seating grooves may be recessed within the exterior surface 43 of the piston member to assure stabilized securement of the sealing means. Motion limiting means limit the extent of forward travel of the piston member within the bore. Suitable motion limiting means may be provided by the flat seat member 32 of first check valve 30. Alternatively, said motion limiting means may be a coupling collar 50 disposed upon exterior surface 43 of the piston adjacent inlet end 35 and adapted to abut against inlet extremity 23 of the cylinder member.

In the operation of the device of this invention, the downstream extremity 45 of the upstream length 13 of garden hose is coupled to fitting 38 of device 10, and the upstream extremity 46 of garden hose 14 is coupled to fitting 27. By manually manipulating the piston member with one hand back and forth within the cylinder member which is held in the other hand, water is caused to flow upwardly out of swimming pool 18, through the device 10 and into sewer drain 19. Once such siphon flow is initiated, the device can be left unattended. Handgrip means may be associated with either or both the cylinder or piston member to facilitate the requisite manipulation. Collars 50 and 53 may serve as suitable handgrip means, in which case, said collars may be made to have roughened outer surfaces.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

What is claimed is:

1. A siphon initiating device comprising:

a) a cylinder member having a smooth internal bore elongated upon a straight axis between an open inlet extremity and an exit extremity containing means for engaging a hose;

b) a first check valve disposed within said bore adjacent said exit extremity and adapted to enable liquid to flow from said bore unidirectionally out of said exit extremity;

c) a hollow piston member having an open exit end and inlet end equipped with means for engaging a hose;

d) sealing means disposed about said piston member in a manner to produce a substantially fluid-tight seal with said bore while permitting reciprocating sliding movement of said piston member within said bore;

e) a second check valve disposed within said piston member and adapted to enable liquid to flow undirectionally through said hollow piston member, whereby f) said cylinder member and interactive piston member function as a pump which advances liquid through said device when said piston member is repeatedly manipulated back and forth within said cylinder member.

2. The device of claim 1 wherein said cylinder and piston members are fabricated of rigid plastic material.

3. The device of claim 2 wherein said plastic material is polyvinyl chloride.

4. The device of claim 3 wherein said bore has a diameter of between about ⅝" and one inch.

5. The device of claim 4 wherein the exit extremity of said cylinder member has an apertured panel.

6. The device of claim 5 wherein said means for engaging a garden hose is a threaded garden hose fitting.

7. The device of claim 1 wherein a bushing is attached to said cylinder member as an extension thereof, said attachment being achieved by a coupling collar adhered to both said bushing and cylinder member.

8. The device of claim 1 wherein a bushing is attached to said piston member as an extension thereof, said attachment being achieved by a coupling collar adhered to both said bushing and piston member.

9. In a siphon system for transporting water by gravity flow from a source volume of water bounded by a circuitous confining wall having an upper perimeter to a receiving location at a lower elevation than said source volume, said system employing a water-filled conduit having a first extremity immersed below the surface of said source volume, an apogee located above said upper perimeter, and downstream conduit portions divided about said apogee, the improvement comprising disposing a siphon initiating device of claim 1 within said downstream conduit portion.

* * * * *